US006203392B1

(12) United States Patent
Rachel et al.

(10) Patent No.: US 6,203,392 B1
(45) Date of Patent: Mar. 20, 2001

(54) SINGLE ENDED QUARTZ PROJECTION LAMP

(75) Inventors: Bernard W. Rachel, Highland Heights, OH (US); Donald E. Hatfield, Mattoon, IL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/460,176

(22) Filed: Dec. 10, 1999

Related U.S. Application Data

(62) Division of application No. 08/672,791, filed on Jun. 28, 1996, now Pat. No. 6,011,353.

(51) Int. Cl.[7] ..... H01J 9/00
(52) U.S. Cl. ..... 445/27; 313/318.07; 313/318.08
(58) Field of Search ..... 313/318.05, 318.07, 313/318.08, 578, 579; 445/22, 23, 27

(56) References Cited

U.S. PATENT DOCUMENTS 3,469,140 * 9/1969 Bottone et al. ..... 313/318
4,785,218 * 11/1988 Kohl et al. ..... 313/318.08

* cited by examiner

*Primary Examiner*—Kenneth J. Ramsey
*Assistant Examiner*—Todd Reed Hopper
(74) *Attorney, Agent, or Firm*—Christine K. Garcia; Li-Hua Luo

(57) ABSTRACT

This invention consists of an improved design and assembly process the for manufacture of a single ended quartz (SEQ) lamp having three-part leads and a prefocus base for projection applications. This invention consists of a much simpler two-pin prefocus ceramic base SEQ lamp design that is made with fewer parts and is much easier and faster to assemble to enable much reduced labor and cost. Also, the ceramic base is smaller and exposes more of the quartz lamp seal to the surroundings to enable more effective cooling during lamp operation to prevent lamp failures from overheated seals. Also, the ceramic base is designed for quick assembly with the coil correctly focused to the base.

7 Claims, 2 Drawing Sheets

SINGLE ENDED QUARTZ PROJECTION LAMP

This application is a divisional of U.S. application Ser. No. 08/672,791, filed Jun. 28, 1996, is now U.S. Pat. No. 6,011,353.

FIELD OF THE INVENTION

This invention relates to a novel base configuration for a single ended quartz lamp and associated ceramic base portion as are used in projection lighting applications. More particularly, this invention relates to such a lamp and base configuration that provides the necessary prefocus characteristics using a reduced number of components as well as having associated therewith, a simpler process of manufacture.

BACKGROUND OF THE INVENTION

Conventional single ended quartz (SEQ) lamps for use in projection applications typically consist of a quartz wire lamp focused and cemented in a ceramic base with two attached base pins leading externally of the lamp envelope for connection to a source of power. The quartz wire lamp includes a filament, foil leads that are disposed within the seal region of the lamp envelope, and external molybdenum leads which are connected to power. The ceramic base includes brass pins with center holes inserted into openings in the ceramic base, and typically staked in place. The electrical connection from a power source to the filament is a four piece system comprising the brass pins, nickel wire leads, molybdenum wire leads, and molybdenum foil leads.

Specifically, one embodiment of an SEQ lamp known in the art and sold by General Electric is shown in FIGS. 1–3. This SEQ lamp is a standard quartz wire lamp with a filament housed inside a quartz envelope. The two ends of the filament are welded to wire lamp foil leads. The foil leads are then sealed in one end of the quartz envelope. External molybdenum leads welded to the wire lamp foil leads extend out of the seal.

Specifically, two 0.060" (1.5 mm) diameter, nickel plated brass pins are inserted and staked into holes in the ceramic base where the holes extend from the inside cavity of the base to the other end of the ceramic base. The nickel plated brass pins are hollow. Further, each pin has a center hole therethrough and out the outer end.

The external molybdenum leads on the wire lamp are then trimmed below the seal with no more remaining length than needed to weld outer extension leads thereon. Nickel outer leads are welded to the exposed portions of the external molybdenum leads. The welded outer extension leads are threaded through the center holes in base pins to the correct light center length (LCL), i.e. the distance from the center of the filament to the bottom of the ceramic base.

The wire lamp and ceramic base are clamped in place and the excess welded outer extension lead wire is trimmed away. The remaining lead wire is welded to the inside of the nickel plated brass pins. Cement is introduced through a center hole in the bottom of the base whereby the inside cavity of the ceramic base around the wire lamp seal is filled with cement. The wire lamp is then adjusted to center the coil over the base in both the up-down (vertical) and the left-right (horizontal) direction. Finally, the lamp assembly is heated to set the cement.

This and other current designs for based SEQ lamps for projection applications include numerous parts that assist in the focusing operation during assembly. The focusing operation adds significant time and labor expense to the manufacture of each SEQ lamp for projection applications. These current designs with large ceramic bases with large aliquots of cement around quartz wire lamp seals retain heat and thus may prohibit cooling needed for prevention of lamp failure from overheated seals.

SUMMARY OF THE INVENTION

The present invention is a single ended, quartz projection lamp including a more advanced quartz wire lamp, a smaller ceramic base, and a cement fill. The quartz wire lamp envelope is hermetically sealed to define an inner chamber housing a filament. The filament has two ends welded to foil leads in the hermetic seal. The ceramic base has an envelope receiving slot therein with a pair of holes extending from the slot through the ceramic base. The pair of leads, electrically connected to the ends of the filament, extend into and through the ceramic base where an exposed portion of each lead is directly connectable to a power source. The cement fill is in the envelope slot below the seated hermetic seal of the envelope for bonding the envelope to the base.

The present invention is further a method of assembling a single ended quartz projection lamp where the correct light center length as defined from the center of the filament of the lamp to the bottom of the base of the lamp is always met by assembly of the lamp without adjustment of the lamp in the base. The method involves inserting the pair of wire lamp leads extending from the wire lamp envelope through a pair of corresponding holes in a slot within a ceramic base such that ends of the leads extend through and out of the ceramic base. The method then includes stopping the insertion of the wire lamp leads into the holes by a raised portion of the envelope seal engaging an outer lip of the slot in the ceramic base. The method finally includes applying cement into the slot below the seal to secure the envelope to the ceramic base.

In addition, the method includes in more detailed embodiments, shaping an exposed portion of the wire lamp leads to form base pin ends connectable to a power source. The method may further include electrically connecting the pair of wire lamp leads to a corresponding pair of filament ends. In more detail, the method includes defining an envelope hermetically sealed to contain a filament with the pair of filament ends connected to leads in the hermetic seal, as well as defining each wire lamp lead as a molybdenum foil welded to an outer molybdenum wire which in turn is welded to an outer nickel wire.

Accordingly, it is an objective of the present invention to improve the design and assembly process for manufacturing two-pin single ended quartz lamps having a prefocused base for projection applications.

One of the advantages of the present invention is a simpler design.

In furtherance of this advantage, the present invention advantageously uses less than the four parts required in the prior art designs from the filament to the power source.

Another advantage of the present invention is the use of fewer parts to obtain a prefocused base on a two pin single ended quartz lamp.

An additional advantage of the present invention is ease and speed of assembly.

An even further advantage of the present invention is the reduced time and labor cost needed for assembly.

Another advantage is the elimination of extra pins that need to be affixed to the leads.

A further additional advantage is a smaller ceramic base.

Another advantage is improved cooling of the lamp.

An additional advantage is prevention of overheating of seals and thus premature lamp failure from overheated seals.

Other advantages include more exposed lamp surface area for better cooling.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein.

DETAILED DESCRIPTION OF THE PREFERRED EMBODIMENTS

Figure 5:
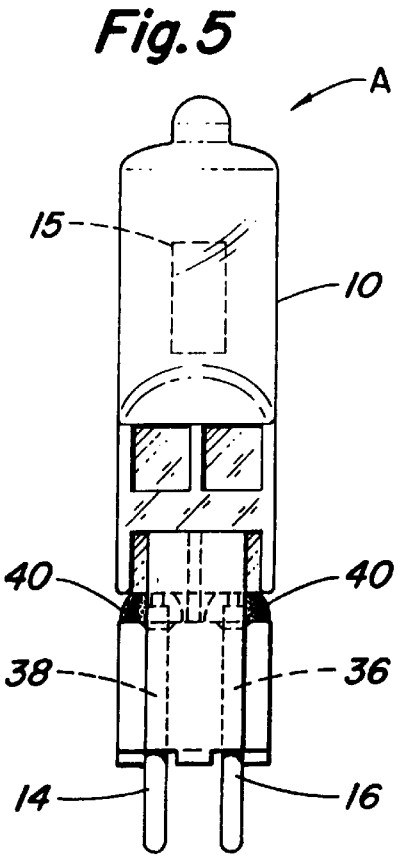
FIG. 5 is an assembled front view of the present invention as shown in FIG. 4; and, FIG. 6 is an assembled side view of the present invention of FIGS. 4 and 5.
Figure 4:
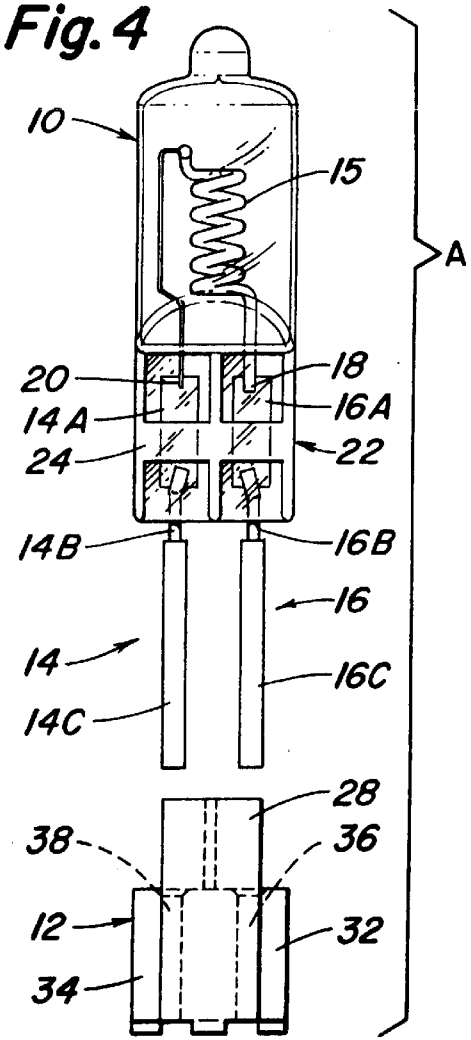
FIG. 4 is an exploded front view of the present invention.

Referring now to the drawings wherein the showings are for the purposes of illustrating the preferred embodiments of the invention only and not for purposes of limiting same, FIG. 4 illustrates an exploded view of an improved single ended, quartz wire lamp A having a quartz envelope 10 mountable within a ceramic base 12. A pair of three part leads 14 and 16 extend both inside the seal region of the envelope 10 and through the base 12 as is shown in FIG. 5 so as to be partially exposed below the base for connection to a power source whereby the leads function as both connectors to the filament as well as base pins connectable to the power source.

The quartz envelope 10 includes a filament 15 with a first end 18 and a second end 20 (via an extension in this embodiment). Both ends 18 and 20 are hermetically sealed within a seal region 22 of the envelope 10 when the envelope shape is formed from a standard quartz tube. The seal region as shown from the side in FIG. 6 is coplanar quartz wire to the filament envelope portion of the lamp which has a voluminous shape for housing the filament 15.

The seal region 22 includes improved seal definition as supplied by a well-defined embossed rail 24 in the seal region 22. The embossed rail is a raised portion resulting from the heat sealing process where the quartz is raised above its softening temperature to approximately 2000° C. The molding or pressing in unison with high temperatures allows the quartz tube to be reshaped and closed with the ends of the filament 18 and 20 extending therethrough whereby the mold is contoured so as to leave the well defined embossed rail 24 which is always a constant, known distance from the filament.

Within the seal region are portions of each of the three part leads 14 and 16. In more detail, each of the three part leads 14 and 16 consist of an inner molybdenum foil 14A and 16A, respectively, an outer molybdenum wire 14B and 16B, respectively, and an outer nickel wire 14C and 16C, respectively, plated or coated resulting in outer leads of a standard dimension, such as 0.060 inch (1.5 mm) diameter as described above. The inner foil portions 14A and 16A of the three part leads 14 and 16 are welded to or otherwise electrically connected to the ends of the filament 18 and 20, and are flat planar sheets hermetically sealed in the seal region 22.

Figure 1:
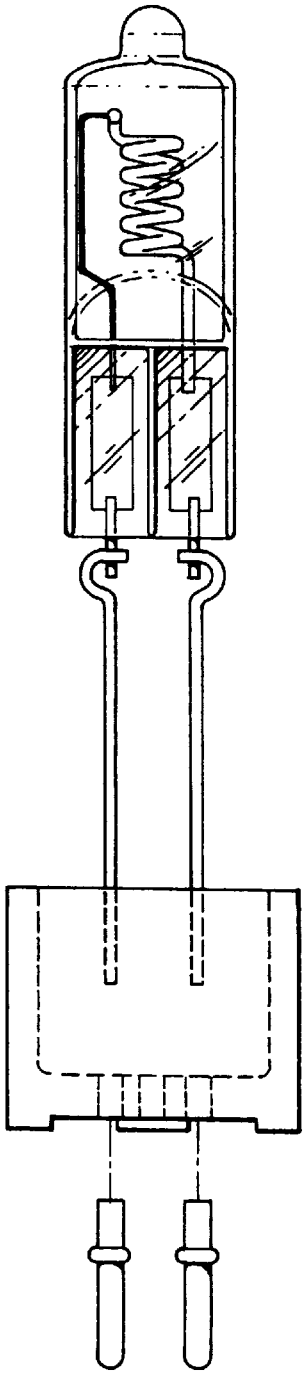
Fig. 1 (PRIOR ART)
FIG. 1 is an exploded front view of a prior art assembly.
Figure 2:
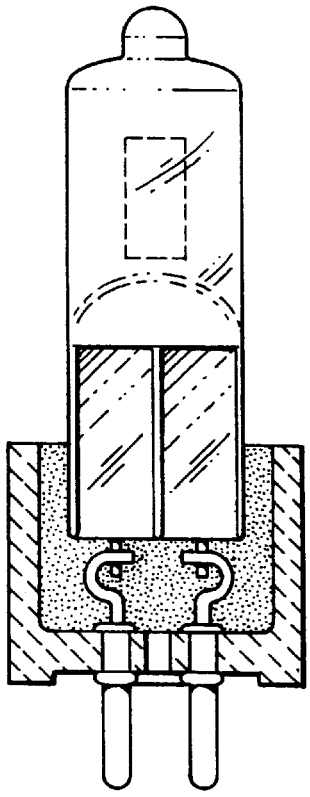
Fig. 2 (PRIOR ART)
FIG. 2 is an assembled front view of the assembly of FIG. 1 with a portion cut away to show the interior of the base.
Figure 3:
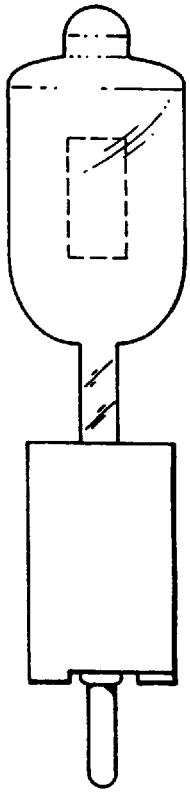
Fig. 3 (PRIOR ART)
FIG. 3 is an assembled side view of the assembly of FIGS. 1 and 2.
Figure 6:
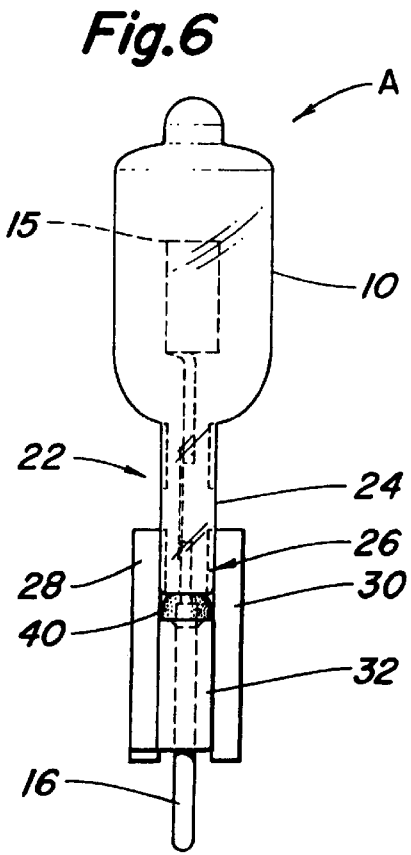

The ceramic base 12 has an envelope receiving slot 26 defined by four sides, two 28 and 30 are taller than the other two 32 and 34 as is shown in FIG. 6. The base is manufactured out of a ceramic material so as to function in an insulative and non-conductive manner.

The improved single ended quartz projection lamp assembly A is easily assembled using less parts and assembly steps than the prior art. Assembly is specifically as follows, wire lamp leads 14 and 16 are electrically connected, typically by welding, to the filament 15 via ends 18 and 20. More specifically, prior to sealing of the envelope, the inner molybdenum leads 14A and 16A are placed in the to-be-sealed region after being welded to the filament ends. The wire lamp outer leads, specifically, the molybdenum and nickel leads 14B, 16B, 14C and 16C which were previously welded together, are inserted through a pair of corresponding holes 36 and 38 in the ceramic base 12. The base 12 is pushed up over the wire lamp seal region 22 until stopped by embossed seal rail 24. The base length is designed such that correct light center length (LCL) as described above is achieved with the base 12 pushed up to the embossed seal rail 24. When the base 12 is pushed up over the seal region 22 of the envelope 10, the wire lamp leads 14 and 16 extend downward from the base and will function as base pins in the finished lamp assembly A.

Cement 40 is applied inside of the base 12 around the wire lamp leads 14 and 16 up to the wire lamp seal region 22. The seating of the ceramic base 12 against the embossed seal rail 24 always results in correct light center length and alignment between the filament 15 and the base 12. This proper light center length and alignment eliminates need for wire lamp adjustment to locate the filament 15 over the base 12.

The lamp assembly A is then heated to set the cement. Finally, the ends of the leads 14 and 16 are shaped to round off and eliminate any sharp edges and form standard base pins.

Referring to FIGS. 4–6, one of the central features of the new design and assembly process invention is the use of a more advanced quartz inner lamp with improved seal definition, an embossed rail in the seal, better control of filament location with respect to the seal and the base, and two layer molybdenum-nickel outer lead wires rather than use of separate leads between the wire lamp and base. Also, nickel outer lead wires eliminate need for separate base pins staked in the ceramic base. Finally, a smaller ceramic base is used that requires far less cement, both of which enable more effective cooling of the lamp while operated in projection equipment resulting in the use of higher wattage lamps with more light output as is always desired in all projection applications.

In addition, the assembly process with parts needed therein as described above are simpler to perform. Specifically, this new design and assembly process has fewer parts and fewer simple assembly operations. Some of the keys being the elimination of the need to adjust the envelope within the cement in the two axial directions thereby also eliminating the need for a comparator or other device used to insure proper LCL, and the elimination of the need to use and install (stake) pins in the base.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

What is claimed is:

1. A method of assembling a single ended, quartz projection lamp where the correct light center length as defined from the center of the filament of the lamp to the bottom of the base of the lamp is always met merely by assembly of the lamp without adjustment, the method comprising:

inserting a pair of wire lamp leads connected to an envelope through a pair of corresponding holes in a slot within a ceramic base such that ends of the leads extend through and out of the ceramic base;

stopping the insertion of the wire lamp leads into the holes upon a raised portion of the envelope seal engaging an outer lip surrounding the slot in the ceramic base; and, applying cement into the seat to secure the envelope to the ceramic base.

2. The method as set forth in claim 1 wherein subsequent to the applying cement step, the following step occurs:

shaping the exposed portion of the wire lamp leads to form base pin ends connectable to a power source.

3. The method as set forth in claim 1 wherein after inserting the pair of wire lamp leads through the pair of corresponding holes, the following step occurs:

electrically connecting the pair of wire lamp leads to a corresponding pair of filament ends.

4. The method as set forth in claim 3 wherein prior to electrically connecting the pair of wire lamp leads to the filament ends, the following step occurs:

defining an envelope hermetically sealed to contain a filament with the pair of filament ends exposed through the hermetic seal.

5. The method as set forth in claim 4 wherein the hermetic seal is defined by molding heated quartz.

6. The method as set forth in claim 5 wherein the molding step further comprises defining the raised portion during the molding process.

7. The method as set forth in claim 4 wherein prior to electrically connecting the pair of wire lamp leads to the filament ends, the following step occurs:

defining each wire lamp lead as a three-part lead consisting of a molybdenum foil welded to an outer molybdenum wire which is, in turn, welded to an outer nickel wire.

* * * * *